United States Patent [19]

Petrovich

[11] Patent Number: 4,466,886

[45] Date of Patent: Aug. 21, 1984

[54] FROTH FLOTATION METHOD FOR RECOVERING MINERALS

[76] Inventor: Vojislav Petrovich, 1935 W. Schiller St., Chicago, Ill. 60622

[21] Appl. No.: 425,440

[22] Filed: Sep. 28, 1982

[51] Int. Cl.[3] ..... B03D 1/14

[52] U.S. Cl. ..... 209/166; 75/2; 252/61

[58] Field of Search ..... 209/166, 167; 252/61; 423/87, 139, 150; 75/2, 119, 121

[56] References Cited

U.S. PATENT DOCUMENTS

| | | | |
|---|---|---|---|
| 1,449,797 | 3/1923 | Vivian | 209/166 |
| 2,875,896 | 3/1959 | Last et al. | 252/61 |
| 3,703,573 | 11/1972 | Blytus | 564/253 |
| 3,743,585 | 7/1973 | Lowenhaupt | 75/119 |
| 3,907,966 | 9/1975 | Skarbo | 423/139 |
| 4,026,988 | 5/1977 | Wells et al. | 423/87 |
| 4,142,952 | 3/1979 | Dalton | 423/139 |
| 4,234,546 | 11/1980 | Zeeuw et al. | 423/139 |
| 4,269,702 | 5/1981 | Milner et al. | 75/2 |

FOREIGN PATENT DOCUMENTS

| | | | |
|---|---|---|---|
| 874700 | 6/1971 | Canada | 209/166 |
| 738672 | 3/1978 | U.S.S.R. | 209/166 |

*Primary Examiner*—Bernard Nozick

[57] ABSTRACT

An improved method for concentration of nickel, cobalt, and bismuth minerals from their ores by froth flotation process which comprises; subjecting a sufficiently fine sized ore of nickel, or cobalt, or bismuth metals in the presence of nitrosoguanidine cyclohexanol or pyridil ketoxime cyclohexanol, or phenethylcyclohexanedioxime, pr pyridil ketoxime, nitrosoguanidine; the indicated compounds provide selectivity and recovery of nickel, and cobalt, and bismuth minerals from distinct mineral slurry of said metal values.

6 Claims, No Drawings

FROTH FLOTATION METHOD FOR RECOVERING MINERALS

This invention relates to froth flotation of nickel, cobalt, and bismuth ores using cyclohexanedionedioxime, or phenethylcyclohexanedione dioxime as collector for recovering nickel, cobalt, and bismuth minerals from their ores. Said dioximes are added in a ammoniacal slurry during the conditioning stage after the grinding and sizing the ore treated.

Accordingly, this invention has as an object the provision of a practical and economical process for the heneficiation of nickel, cobalt, and bismuth ores, which by the invented method are becoming amenable to froth flotation, which until now were mostly chemically extracted by liquid-liquid processes, or if coarse then by gravity recovered, and finaly as nickel-cobalt matte from which copper is separated by metallurgical treatment. By this invention all these method are eliminated. Another object of this invention is to provide reagents specific to nickel, and by changing the PH value of the pulp of mineral slurry the bismuth mineral can be recovered. Thus, providing by manipulation of the pH value a concentration treatment for the beneficiation of nickel metal metal value only, with maximum recovery of said minerals from respective ores in a floated froth formed by agitating and aerating the pulp of mineral slurry, with a relatively low consumption of reagents.

By changing the pH from 8 to 12 the bismuth metal value can be recovered by the same reagent at the same flotation machine by agitating and aerating the pulp of mineral slurry.

Soluble alkyl, aryl, alkylaryl or cyclo dioximes are specific reagents for the recovering at room temperature the nickel mineral from neutral to strongly ammoniacal mineral slurry. Under these conditions no other metallic minerals are levitated or occluded in the froth. From a weakly acid mineral slurry no nickel mineral is levitated in the froth. There is no froth flotation of nickel minerals from acid pulp of mineral slurry. Dioxime reagents can react also with cobalt and bismuth but under different conditions which will be described.

In said invention are experimented the following reagents:

Phenethyl cyclohexanedione dioxime

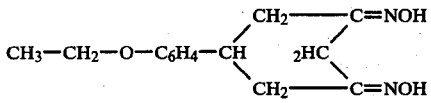

Nitrosoguanidine cyclohexanol

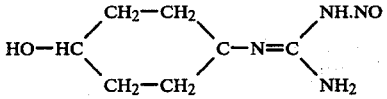

Pyridil ketoxime cyclohexanol

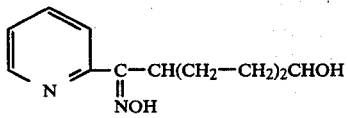

The other constituents of the reagents add in froth formation, and in this way develop the flotation and recovering of said minerals, the nickel, cobalt, and bismuth minerals. Many variations in the formula may be performed, to obtain a cheaper product, and healthly safer, but not in the active group which must be so arranged to make with the metal and two nitrogen atoms a five or six membered ring.

Dimethylglyoxime which is the parent of these compounds is only a good analytical reagent and does not give results in flotation of nickel mineral, does not develop a froth which is needed to separate said minerals from gangue, because it has not the weight, i.e., the flotation mass. The enumerated and claimed reagents are capable to float in water suspended mineral to the surface, therefore they are flotation reagents.

Said real flotation collectors are soluble in water in contrast to dimethylglyoxime which as analytical reagent which must be used in alcoholic solution. The last two reagents despite that they have not the true dioxime grouping, having nitroso group, or in the last reagent the ketoxime group which is bound to pyridine, i.e., in nitrosoguanidine cyclohexanedione or cyclohexanol the active group is represented as

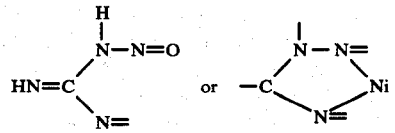

while in pyridil cyclohexanedione or cyclohexanol ketoxime, the active group is represented as

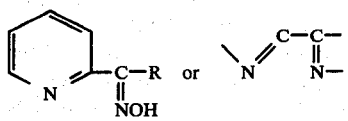

The active groups of the nitrosoguanidine, and the pyridil ketoxime are represented with two nitrogen-nitrogen activity. Consequently, nickel cobalt and bismuth bound with two nitrogen atoms so furtheron we will speak of nitrogen-nitrogen reagents.

If the ore contains nickel and cobalt, said metal values may be conveniently separately recovered. However, in flotation of nickel mineral in the presence of cobalt minerals in the same working mineral slurry, it is necessary to add to the ammoniacal slurry a sufficient quantity of nitrogen-nitrogen reagent to combine with all cobalt mineral at its surface to insure complete flotation and recovering in the froth the nickel mineral. It cannot be elucidated why cobalt mineral does not attach to the froth and float to the surface of the mineral slurry. Maybe it is highly wetted by hydroxyl ions and very hydrated ammonia. Alkali hydroxide, alkali cyanide, as well as oxidizing agents are harmful and destroy the complex of nickel reagent from the surface of nickel mineral, harming in this way the flotation of nickel mineral. Under said conditions the nickel mineral is floated and recovered as froth concentrate.

The mineral slurry from which the nickel mineral is recovered, and the cobalt mineral-reagent komplex is wet and sustained in the slurry as depressed mineral may be recovered when to this slurry of the cobalt flotation machines is added alkali sulfide or ammonium polysulfide, which does not destroy the ammoniacal cobalt nitrogen-nitrogen mineral complex. After passing of some time or several flotation machines, the addition of sulfuric acid, i.e., after acidifying the pulp of mineral slurry, a cobalt froth develops instantly carrying cobalt mineral.

Th. flotation of cobalt with nitrogen-nitrogen reagent and a sulfide or polysylfide coreagent can be made considerably more sensitive by oxidizing the surface of cobalt mineral to the trivalent state by means of hydrogen peroxide. After oxidation the pulp of mineral slurry is acidified, upon which a froth begins to develop, which makes the recovery of cobalt mineral possible from a pulp of mineral slurry of which the nickel mineral is eliminated by successful prior recovering. Because of said procedure the nickel circuit must be kept separated. Also the addition of hydrogen peroxide to the cobalt circuit must be cautious almost exactly as needed, especially because the percentage of cobalt minerals is always very small.

If bismuth is present in tungsten ore, tin ore, or the antimony ore, or any ore with small amount of bismuth mineral, in which it is always an accessory or very accessory mineral value, but of great economic interest, it may be recovered from table balk concentrate where it may occure in several percent by applying the flotation procedure with nitrogen-nitrogen reagents.

The procedure as experimented with Korea and Portugal tungsten ores is as follows: the mineral slurry with a certain bismuth mineral or native bismuth, is made strongly alkaline with ammonia pH 11 to 12, then is added one of enumerated dioxime reagent. Under normal mill temperature voluminous froth develops and the bismuth mineral is recovered. Two or three flotation machine of smaller size are sufficient to recover bismuth mineral or native bismuth from a mineral slurry containing gravity concentrates either of tungsten mineral, or tin mineral, or antimony mineral, or any other mineral. The invented procedure can well be utilized in a cyclic process wherein the decanted and filtered spent water and middling fraction are returned to the process, saving in this way the unused reagents, especially ammonia and the more expensive nitrogen-nitrogen.

By applying the present invention it is feasible to obtain not only selected nickel, cobalt and bismuth minerals but also an increased recovery of said metal values in froth concentrates with a reduction in reagent requirement and costs, a substantial advance is feasible in the field of nickel, cobalt, and bismuth recoveries.

In carrying out of this invention in accordance with the foregoing principle, the nickel, ore is ground sized and preferrably although not necessarily deslimed by washing to remove colloidally dispersed material, and thereafter the sands are diluted to a pulp consistency of generally about 25 percent solids. Thereafter the pulp is conditioned for several minutes by agitating with an amount of the order from 0.05 to 0.5 kg oer ton of ore treated of nitrogen-nitrogen reagent in an ammoniacal mineral slurry of the pH 7 to 8. Said addition to a pulp of mineral slurry with nickel metal value, produce a floating froth product of nickel mineral. Besides a rougher a cleaner procedure may be employed and the invention can well be utilized in a cyclic process wherein the decanted and filtered spent water and the middling ore fraction are returned to the process, saving in this way the unused reagents, as well as omitting the spoiling of environment water courses. The invented process further reduces the need for close plant control in critical areas such as desliming, sizing, conditioning, and reagent rate reducing flotation reagent requirement and processing costs. Thus, efficient results and considerable reagent economy may be effected in the practicing this invention.

In carrying out the invention in accordance with the foregoing principle, cobalt ore is ground sized and preferably although not necessarily deslimed by washing in order to remove colloidally dispersed material. Thereafter, the sands are diluted to a pulp consistency, generally about 25 percent solids, the pulp is made ammoniacal and for several minutes by agitating with an amount of the order from 0.05 to 0.5 kg per ton of ore treated with said nitrogen-nitrogen reagent conditioned in an ammoniacal slurry of the pH 7–8. Hence the cobalt mineral slurry is oxidized with $H_2O_2$ exactly as required to which an amount of sodium sulfide or ammonium polysulfide is added. After conditioning some time no more than 3 minute, the slurry is acidified by addition of sulfuric acid. The slurry is then pumped into the flotation machine bank where instant froth develops carrying cobalt mineral. Besides, a rougher a cleaner procedure may be employed. The invention can be utilized in a cyclic process wherein the decanted and filtered spent water and the middling ore fraction are returned to the process, thereby salvaging the unused reagents as well as avoiding the polution of environmental water sources. Thus efficient results and considerable reagent economy may be affected in the practice of this unique invention.

In ca-rrying out this invention in accordance with the foregoing principle, the bismuth ore is ground sized and, preferably although not necessarily, deslimed by washing in order to remove colloidally dispersed material. Thereafter the sands are diluted to a pulp consistency, generally 25 percent solids. The slurry is made highly ammoniacal, then conditioned for several minutes by agitating with an amount of the order from 0.05 to 0.1 kg per ton of ore treated with said nitrogen-nitrogen reagent being the phenethylcyclohexanedione dioxime in an ammoniacal mineral slurry of the pH 11 to 12. The slurry is pumped into the flotation machine bank where by agitation and aeration instant voluminous froth develops carrying bismuth mineral or native bismuth which is recovered in the evident method.

What is claimed is:

1. In concentrating by froth flotation of nickel, ores, which includes the subjecting of said material when finely ground to froth flotation process in the presence of pyridil ketoxime cyclohexanol promoter-collector; the step of adding to the ammoniacal mineral slurry of the pH 8 an amount of the order from 0.05 to 0.5 kg per ton of ore treated of pyridil ketoxime cyclohexanol; said addition to aqueous dispersion of ore produce a froth floating product of nickel mineral value by continuing agitation and aeration of the aqueous dispersion of ore, and separating and recovering the nickel mineral as float froth concentrate product.

2. In concentrating by froth flotation of nickel ores, which includes the subjecting of said material when finely ground to froth flotation process in the presence of pyridil ketoxime cyclohexanol promoter-collector; the step of adding to the ammoniacal mineral slurry of ph 8 an amount of the order from 0.05 to 0.5 kg per ton of ore treated of said reagent; said addition to aqueous dispersion of ore produce a froth floating product of nickel mineral value by continuing agitation and aeration of the aqueous dispersion of ore, and separating and recovering the nickel mineral as float froth concentrate product.

3. In concentrating by froth flotation of cobalt ores, which includes the subjecting of said material when finely ground to froth flotation process in the presence of nitrosoguanidine cyclohexanol promoter-collector; the step of adding an adequate amount of hydrogen peroxide to a weakly ammoniacal mineral slurry of the pH of an and amount of the order from 0.05 to 0.5 kg per ton or ore treated of nitrosoguanidine cyclohexanol; the step of adding to said reagentized mineral slurry an amount of the order from 0.02 to 0.2 kg per ton of ore treated sodium sulfide or ammonium polysulfide, thereafter the pulp is acidified with sulfuric acid; said additions develop the froth of cobalt metal value by continuing agitation and aeration of the aqueous dispersion of ore, separating the cobalt mineral from other non floating minerals, and recovering the cobalt mineral value as float froth concentrate product.

4. In concentrating by froth flotation of cobalt ores, which includes the subjecting of said material when finely ground to froth flotation process in the presence of nitrosoguanidine cyclohexanol promoter-collector; the step of adding an adequate amount of hydrogen peroxide to a weakly ammoniacal mineral slurry of the pH 8 an amount of the order from 0.05 to 0.5 kg per ton of ore treated of nitrosoguanidine cyclohexanol, the step of adding to said reagentized mineral slurry an amount of the order from 0.02 to 0.2 kg per ton of ore treated sodium sulfide or ammonium polysulfide, thereafter the pulp is acidified with sulfuric acid; said additions develop the froth of cobalt metal value by continuing agitation and aeration of the aqueous dispersion of ore, separating the cobalt mineral from other non floating minerals, and recovering the cobalt mineral value as float froth concentrate product.

5. In concentrating by froth flotation of bismuth ores, which includes the subjecting of said material when finely ground to froth flotation process in the presence of phenthylcyclohexanedione dioxime promoter-collector; the step of adding to the ammoniacal slurry of high alkalinity of the PH 11–12, an amount of the order from 0.02 to 0.2 kg per ton of ore treated of phenethylcyclohexanedione dioxime said addition to aqueous dispersion of ore produce the froth of bismuth metal value by continuing agitation and aeration of the aqueous dispersion or ore, and separating the bismuth mineral value as float froth concentrate product.

6. In concentrating by froth flotation of bismuth ore, which includes the subjecting of said material when finely ground to froth flotation process in the presence of phenethylcyclohexanedione dioxime promoter-collector; the step of adding to the ammoniacal slurry of high alkalinity of the pH 11–12, an amount of the order from 0.02 to 0.2 kg per ton of ore treated of phenethylcyclohexanedione dioxime; said addition to aqueous dispersion of ore produce the froth of bismuth metal value by continuing agitation and aeration of the aqueous dispersion of ore, and separating the bismuth mineral value as float froth concentrate product.

* * * * *